US010390558B2

(12) United States Patent
Dincer

(10) Patent No.: US 10,390,558 B2
(45) Date of Patent: Aug. 27, 2019

(54) AEROSOL-GENERATING ARTICLE COMPRISING A TRANSPARENT TUBE

(71) Applicant: PHILIP MORRIS PRODUCTS S.A., Neuchatel (CH)

(72) Inventor: Ahmet Dincer, Le Mont-sur-Lausanne (CH)

(73) Assignee: Philip Morris Products S.A., Neuchatel (CH)

( * ) Notice: Subject to any disclaimer, the term of this patent is extended or adjusted under 35 U.S.C. 154(b) by 0 days.

(21) Appl. No.: 15/529,725

(22) PCT Filed: Dec. 23, 2015

(86) PCT No.: PCT/EP2015/081161

§ 371 (c)(1),
(2) Date: May 25, 2017

(87) PCT Pub. No.: WO2016/102668

PCT Pub. Date: Jun. 30, 2016

(65) Prior Publication Data

US 2017/0325497 A1 Nov. 16, 2017

(30) Foreign Application Priority Data

Dec. 24, 2014 (EP) ..... 14200314

(51) Int. Cl.
*A24D 3/06* (2006.01)
*A24D 1/04* (2006.01)
(Continued)

(52) U.S. Cl.
CPC ..... *A24D 3/062* (2013.01); *A24D 1/02* (2013.01); *A24D 1/045* (2013.01); *A24D 3/06* (2013.01);
(Continued)

(58) Field of Classification Search
CPC ..... A24D 3/062; A24D 3/0295; A24D 1/045; A24D 3/10; A24F 47/008
(Continued)

(56) References Cited

U.S. PATENT DOCUMENTS 3,370,592 A * 2/1968 Schultz ..... A24D 3/04 131/334
3,628,543 A * 12/1971 Bemont ..... A24F 13/06 131/215.3
(Continued)

FOREIGN PATENT DOCUMENTS

CN 102046032 5/2011
CN 102665456 9/2012
(Continued)

OTHER PUBLICATIONS

Search Report issued in Europe for Application No. 14200314.4-1656 dated Jul. 8, 2015 (5 pages).
(Continued)

*Primary Examiner* — Hae Moon Hyeon
(74) *Attorney, Agent, or Firm* — Mueting, Raasch & Gebhardt, P.A.

(57) ABSTRACT

There is provided an aerosol-generating article (10; 100) comprising an aerosol-generating substrate (12) and a mouthpiece (14) secured to the aerosol-generating substrate (12). The mouthpiece (14) comprises at least one filter segment (18, 20) and a substantially transparent tubular segment (22) defining an empty cavity extending substantially longitudinally through the substantially transparent tubular segment (22), wherein aerosol passing through the empty cavity during use of the aerosol-generating article (10; 100) is visible from the exterior of the aerosol-generating article (10; 100) through the substantially transparent tubular segment (22).

15 Claims, 2 Drawing Sheets

(51) Int. Cl.
*A24D 3/10* (2006.01)
*A24F 47/00* (2006.01)
*A24D 1/02* (2006.01)

(52) U.S. Cl.
CPC ..... *A24D 3/10* (2013.01); *A24F 47/006* (2013.01); *A24F 47/008* (2013.01)

(58) Field of Classification Search
USPC ..... 131/329, 346, 328, 331
See application file for complete search history.

(56) References Cited

U.S. PATENT DOCUMENTS 4,414,989 A * 11/1983 Moragrega ..... A24D 3/045 131/338
8,393,334 B2 3/2013 Cecchetto
8,616,219 B2 12/2013 Richardson
2006/0150991 A1 7/2006 Lee
2009/0293894 A1 12/2009 Cecchetto
2012/0085359 A1* 4/2012 Sutton ..... A24C 5/471 131/280
2012/0305014 A1* 12/2012 Richardson ..... A24D 1/02 131/284
2013/0139836 A1* 6/2013 Blick ..... A24D 3/041 131/331
2013/0140197 A1* 6/2013 Fiebelkorn ..... A24D 1/042 206/205
2014/0076338 A1* 3/2014 Kaljura ..... A24D 3/043 131/281
2014/0202479 A1* 7/2014 Nicholls ..... A24D 3/048 131/337
2014/0224268 A1* 8/2014 Ryter ..... A24D 3/045 131/332
2014/0290678 A1* 10/2014 Besso ..... A24D 3/04 131/337
2015/0090282 A1* 4/2015 Lewis ..... A24D 3/048 131/332
2015/0208722 A1 7/2015 Kadiric
2015/0296875 A1 10/2015 Camus
2016/0143355 A1* 5/2016 Borges ..... A24F 47/006 131/329
2016/0270437 A1* 9/2016 Nappi ..... A24D 1/02

FOREIGN PATENT DOCUMENTS

CN 103796537 5/2014
EA 019871 6/2014
EP 2789248 10/2014
GB 2490740 11/2012
RU 2012145730 5/2014
TW 201412254 5/2018
TW 201438606 12/2018
WO WO 2004/068975 8/2004
WO WO 2012/156708 11/2012
WO WO 2013/068081 5/2013
WO WO 2014/001388 1/2014

OTHER PUBLICATIONS

International Search Report and Written Opinion for PCT/EP2015/081161 dated Mar. 7, 2016 (7 pages).
International Preliminary Report on Patentability for PCT/EP2015/081161 dated Dec. 13, 2016 (10 pages).
Office Action issued in Taiwan for Application No. 104141851 dated May 23, 2019 (19 pages). English translation included.
Office Action issued in China for Application No. 201580067820.5 dated May 31, 2019 (15 pages). English translation included.
Office Action issued in Russia for Application No. 2017124987 dated May 27, 2019 (14 pages). English translation included.

* cited by examiner

AEROSOL-GENERATING ARTICLE COMPRISING A TRANSPARENT TUBE

This application is a U.S. National Stage Application of International Application No. PCT/EP2015/081161, filed Dec. 23, 2015, which was published in English on Jun. 30, 2016, as International Publication No. WO 2016/102668 A1. International Application No. PCT/EP2015/081161 claims priority to European Application No. 14200314.4 filed Dec. 24, 2014.

BACKGROUND

The present invention relates to an aerosol-generating article comprising a mouthpiece including a substantially transparent tubular segment. The invention finds particular application as an elongate smoking article, such as a cigarette.

Filter cigarettes typically comprise a cylindrical rod of tobacco cut filler surrounded by a paper wrapper and a cylindrical filter axially aligned in an abutting end-to-end relationship with the wrapped tobacco rod. The cylindrical filter typically comprises a filtration material circumscribed by a paper plug wrap. Conventionally, the wrapped tobacco rod and the filter are joined by a band of tipping wrapper, normally formed of an opaque paper material that circumscribes the entire length of the filter and an adjacent portion of the wrapped tobacco rod.

A number of smoking articles in which tobacco is heated rather than combusted have also been proposed in the art. In heated smoking articles, an aerosol is generated by heating a flavour generating substrate, such as tobacco. Known heated smoking articles include, for example, electrically heated smoking articles and smoking articles in which an aerosol is generated by the transfer of heat from a combustible fuel element or heat source to a physically separate aerosol forming material. During smoking, volatile compounds are released from the aerosol forming substrate by heat transfer from the fuel element and entrained in air drawn through the smoking article. As the released compounds cool they condense to form an aerosol that is inhaled by the consumer. Also known are smoking articles in which a nicotine-containing aerosol is generated from a tobacco material, tobacco extract, or other nicotine source, without combustion, and in some cases without heating, for example through a chemical reaction.

Some smoking articles proposed in the art include a window provided in a wrapper, such as a tipping wrapper, the window allowing a consumer to observe the effectiveness of an underlying filter segment by observing discolouration of the filter segment at the end of the smoking experience. However, such a construction only allows the consumer to observe the effect towards the end of the smoking experience, as it is necessary for the discolouration to accumulate throughout the smoking experience before the effect is noticeable.

It would be desirable to provide a novel aerosol-generating article that provides an observable effect inside the aerosol-generating article throughout the entire smoking experience.

SUMMARY

According to the present invention there is provided an aerosol-generating article comprising an aerosol-generating substrate and a mouthpiece secured to the aerosol-generating substrate. The mouthpiece comprises at least one filter segment and a substantially transparent tubular segment defining an empty cavity extending substantially longitudinally through the substantially transparent tubular segment, wherein aerosol passing through the empty cavity during use of the aerosol-generating article is visible from the exterior of the aerosol-generating article through the substantially transparent tubular segment.

DETAILED DESCRIPTION

Figure 1:
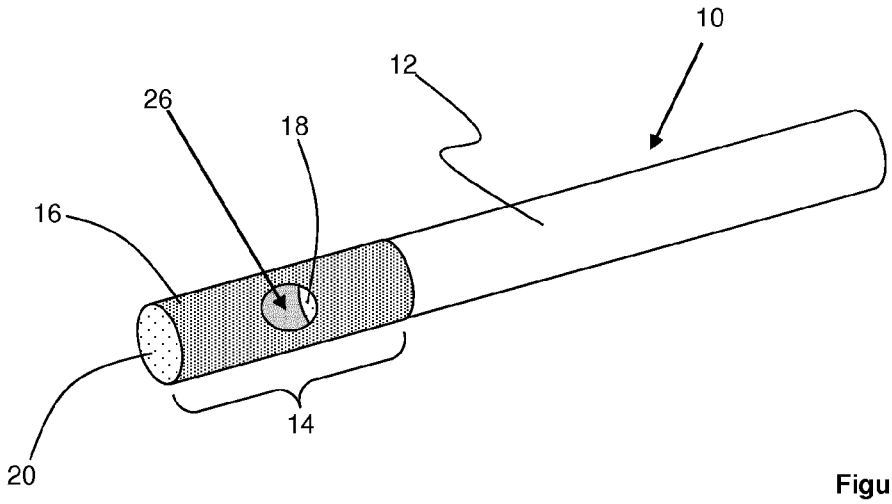
FIG. 1 shows a perspective view of an aerosol-generating article in accordance with a first embodiment of the present invention.

As used herein, the term 'aerosol-generating substrate' is used to describe a substrate capable of releasing, upon heating, volatile compounds, which can form an aerosol. The aerosol generated from aerosol-generating substrates may be visible or invisible and may include vapours (for example, fine particles of substances, which are in a gaseous state, that are ordinarily liquid or solid at room temperature) as well as gases and liquid droplets of condensed vapours.

As used herein, the terms 'upstream' and 'downstream' are used to describe the relative positions of elements, or portions of elements, of the aerosol-generating article in relation to the direction in which a consumer draws on the aerosol-generating article during use thereof. Aerosol-generating articles as described herein comprise a downstream end (that is, the mouth end) and an opposed upstream end. In use, a consumer draws on the downstream end of the aerosol-generating article. The downstream end is downstream of the upstream end, which may also be described as the distal end.

The term 'substantially transparent' is used to describe a material which allows at least a significant proportion of incident light to pass through it, so that it is possible to see through the material. In the present invention, the substantially transparent tubular segment allows sufficient light to pass through it so that smoke or one or more other aerosols generated by the aerosol generating substrate during smoking of the aerosol-generating article are visible through the substantially transparent tubular segment. The substantially transparent tubular segment may be completely transparent. Alternatively, the substantially transparent tubular segment may have a lower level of transparency while still transmitting sufficient light that the smoke or one or more other aerosols is visible through the substantially transparent tubular segment.

Aerosol-generating articles according to the present invention incorporate a substantially transparent tubular segment into the mouthpiece, which advantageously allows the consumer to observe mainstream smoke, or another aerosol generated by the aerosol-generating substrate, passing through the aerosol-generating article during the entire smoking experience. That is, the substantially transparent tubular segment forms an empty cavity or channel extending through the substantially transparent tubular segment, wherein mainstream smoke or other aerosol passing through the empty cavity or channel can be observed from the exterior of the aerosol-generating article through the substantially transparent tubular segment. Substantially no filter materials are provided within the empty cavity of the substantially transparent tubular segment. This is in contrast to known smoking articles incorporating a windowed or a transparent wrapper overlying a filter segment, which only allows the consumer to observe the underlying filter segment.

In some embodiments, the substantially transparent tubular segment or at least one portion thereof may be tinted or coloured, providing that sufficient incident light is still transmitted through the substantially transparent tubular segment to allow the consumer to observe the smoke or other aerosol generated by the aerosol-generating substrate as it passes through the aerosol-generating article. Different portions of the substantially transparent tubular segment may be tinted or coloured with the same or different colours.

In smoking articles according to the invention, the substantially transparent tubular segment forms a discrete filter component which is axially aligned with the at least one filter segment of the filter. Preferably, the substantially transparent tubular segment is axially aligned in an abutting end-to-end relationship with the at least one filter segment of the filter, which may be upstream or downstream, or both upstream and downstream of the substantially transparent tubular segment.

In any of the embodiments described above, an outer diameter of the at least one filter segment is preferably substantially the same as an outer diameter of the substantially transparent tubular segment. Providing at least one filter segment and a substantially transparent tubular segment having substantially the same diameter can simplify the construction of the aerosol-generating article, particularly in embodiments in which a wrapper is wrapped around the at least one filter segment and the substantially transparent tubular segment.

In any of the embodiments described above, and particularly in those embodiments in which the substantially transparent tubular segment has substantially the same diameter as the at least one filter segment, the aerosol-generating article may include a substantially transparent wrapper circumscribing at least a portion of each of the substantially transparent tubular segment and the at least one filter segment to secure the substantially transparent tubular segment to the at least one filter segment. For example, the substantially transparent wrapper may be a substantially transparent combining plug wrap, which secures the substantially transparent tubular segment and the at least one filter segment together to form the mouthpiece. Using a substantially transparent wrapper to secure the mouthpiece segments together advantageously allows the consumer to observe the interior of the substantially transparent tubular segment through the substantially transparent wrapper.

In those embodiments comprising a substantially transparent wrapper, the thickness of the substantially transparent wrapper is preferably at least about 25 micrometers, and more preferably between about 25 micrometers and about 75 micrometers. Additionally, or alternatively, the basis weight of the substantially transparent wrapper is preferably at least about 40 grams per square meter, and more preferably between about 40 grams per square meter and about 80 grams per square meter.

Suitable materials for use as the substantially transparent wrapper include but are not limited to cellophane and polypropylene.

The substantially transparent wrapper or at least one portion thereof may be tinted or coloured, providing that sufficient incident light is still transmitted through the substantially transparent wrapper to allow the consumer to observe the smoke or other aerosol generated by the aerosol-generating substrate as it passes through the substantially transparent tubular segment. Different portions of the substantially transparent wrapper may be tinted or coloured with the same or different colours. The colours used in the substantially transparent wrapper may be the same or different from the colours used in the substantially transparent tubular segment to generate a pattern or indicia.

In any of the embodiments described above, the aerosol-generating article may comprise a tipping wrapper circumscribing an end portion of the aerosol-generating substrate and at least a portion of the mouthpiece to secure the mouthpiece to the aerosol-generating substrate. The tipping wrapper comprises at least one cut-out portion overlying at least a portion of the substantially transparent tubular segment so that the substantially transparent tubular segment is visible through the at least one cut-out portion.

The at least one cut-out portion may be any suitable shape, including but not limited to a circle, oval, square, triangle, diamond or rectangle. A single cut-out portion may be provided in the tipping wrapper, or two or more cut-out portions may be provided which are spaced from each other in the longitudinal direction of the aerosol-generating article, or the circumferential direction of the aerosol-generating article, or both. Where two or more cut-out portions are provided, the cut-out portions may be the same size and shape, or at least one of the size and shape may be different.

Instead of a tipping wrapper comprising at least one cut-out, the aerosol-generating article may alternatively comprise a first tipping wrapper circumscribing an end portion of the aerosol-generating substrate and a portion of the mouthpiece to secure the mouthpiece to the aerosol-generating substrate, wherein at least a portion of the substantially transparent tubular segment does not underlie the first tipping wrapper so that at least a portion of the substantially transparent tubular segment is visible. In such embodiments, the aerosol-generating article preferably further comprises a second tipping wrapper circumscribing a portion of the mouthpiece, wherein an upstream end of the second tipping wrapper is spaced apart from a downstream end of the first tipping wrapper to define an aperture band between the first and second tipping wrappers, wherein at least a portion of the substantially transparent tubular segment underlies the aperture band.

Providing a tipping wrapper comprising a cut-out portion, or a first tipping wrapper which does not entirely overlie the substantially transparent tubular segment, provides a portion of the substantially transparent tubular segment that is visible from the exterior of the aerosol-generating article so that a consumer can still observe the smoke of other aerosol generated by the aerosol-generating substrate as it passes through the aerosol-generating article.

In those embodiments comprising a cut-out portion in a tipping wrapper, or an aperture band formed between first and second tipping wrappers, the cut-out portion or the aperture band is preferably spaced at least about 2 millimeters from the circumferential upstream edge of the tipping wrapper adjacent the aerosol-generating substrate, more preferably at least about 5 millimeters. Where the tipping wrapper extends along the aerosol-generating substrate by between about 2 millimeters and about 5 millimeters from the upstream end of the mouthpiece adjacent the aerosol-generating substrate, this spacing of the cut-out portion or the aperture band ensures that the cut-out portion or the aperture band overlies the mouthpiece rather than the tobacco rod.

Additionally, or alternatively, the at least one cut-out portion in the outer wrapper is preferably provided at least about 10 millimeters from the downstream end of the mouthpiece. This spacing helps to avoid any contact, during smoking, between the lips of the consumer and the area of the substantially transparent tubular segment, and where present the area of the substantially transparent wrapper, that is exposed through the cut-out portion.

In any of the embodiments described above, the material forming the substantially transparent tubular segment may comprises at least one of thermoplastics, including but not limited to polyethylene, low density polyethylene (LDPE), high density polyethylene (HDPE), acrylonitrile butadiene styrene (ABS), polypropylene, polystyrene, polycarbonate, polyvinyl chloride (PVC) and the like, and mixtures thereof. Such materials advantageously provide sufficient stiffness to allow convenient handling of the substantially transparent tubular segment during construction of the aerosol-generating article, as well as preventing deformation or collapse of the substantially transparent tubular segment when the aerosol-generating article is handled by a consumer. Such materials may also advantageously facilitate cutting of the substantially transparent tubular segment on high speed manufacturing machines.

Additionally, or alternatively, the aerosol-generating article may comprise a coating material provided on an inner surface of the substantially transparent tubular segment, wherein the coating material comprises at least one of a hydrophobic substance, an oleophobic substance, a hydrophobic and oleophobic substance, and mixtures thereof. Such materials advantageously reduce the accumulation of particulate matter from the aerosol-generating substrate on an inner surface of the substantially transparent tubular segment, which would otherwise reduce the transparency of the substantially transparent tubular segment during the smoking experience and prevent the consumer observing the smoke or other aerosol generated by the aerosol-generating substrate as it passes through the aerosol-generating article. Many such hydrophobic or oleophobic substances are known and commercially available, examples include but are not limited to silicones, organic or inorganic polysiloxanes, fluorosiloxanes, polyacrylics and mixtures thereof.

Nanoscale compositions comprising such hydrophobic or oleophobic substances may also be used.

In any of the embodiments described above, the substantially transparent tubular segment may be positioned at any location within the mouthpiece. For example, the substantially transparent tubular segment may be positioned at the upstream end of the mouthpiece or the downstream end of the mouthpiece. Preferably, the substantially transparent tubular segment is not positioned at the downstream end of the mouthpiece, so that a conventional opaque tipping wrapper material may be provided at the downstream end of the mouthpiece to retain a conventional mouth feel for a consumer when the downstream end of the mouthpiece is placed against the consumer's lips during smoking. The substantially transparent tubular segment may be positioned at a mouth end of the mouthpiece so that the substantially transparent tubular segment forms a mouth end recess.

Alternatively, the at least one filter segment may comprise at least a first filter segment and a second filter segment, wherein the substantially transparent tubular segment is positioned between the first and second filter segments. Providing the substantially transparent tubular segment in a central portion of the mouthpiece between at least first and second filter segments ensures that a cut-out portion or an aperture band formed by one or more tipping wrappers is sufficiently spaced from the upstream and downstream ends of the mouthpiece.

In any of the embodiments described above, the substantially transparent tubular segment may have a length of between about 2 millimeters (mm) and about 20 mm, between about 5 mm and about 15 mm, or about 7 mm, about 8 mm, about 9 mm, about 10 mm, about 11 mm, or about 12 mm. Providing a substantially transparent tubular segment having a length within this range ensures that the substantially transparent tubular segment is long enough to allow a consumer to observe the smoke or other aerosol passing through the aerosol-generating article during the smoking experience, while also being short enough so that the entire aerosol-generating article can be constructed with a total length similar to the length of a conventional aerosol-generating article, such as a conventional filter cigarette.

Additionally, or alternatively, the substantially transparent tubular segment may be formed from an annular wall of material, wherein the wall has a thickness of between about 0.1 mm and about 2 mm, between about 0.5 mm and about 1.5 mm, or about 0.2 mm, about 0.3 mm, about 0.4 mm, about 0.5 mm, about 0.6 mm, about 0.7 mm, about 0.8 mm, about 0.9 mm or about 1 mm. Providing a substantially transparent tubular segment having a wall thickness within this range ensures that the wall is thick enough so that the substantially transparent tubular segment has the desired stiffness to prevent deformation or collapse of the substantially transparent tubular segment when the aerosol-generating article is handled, while also being thin enough so that the substantially transparent tubular segment can be cut easily during manufacture of the aerosol-generating article and to allow sufficient light to be transmitted through the substantially transparent tubular segment to allow the consumer to observe the smoke or other aerosol passing through the aerosol-generating article during the smoking experience.

Additionally, or alternatively, the substantially transparent tubular segment may have an inner diameter of between about 2 millimeters and about 7 millimeters, between about 3 mm and about 5 mm, or about 3 mm, about 4 mm, or about 5 mm. Providing a substantially transparent tubular segment having an inner diameter within this range ensures that the channel through the substantially transparent tubular segment is small enough to provide a desired wall thickness, while also being large enough so that the substantially transparent tubular segment does not restrict the flow of air through the aerosol-generating article.

Aerosol-generating articles according to the present invention may be filter cigarettes or other aerosol-generating articles in which the aerosol-generating substrate comprises a tobacco material that is combusted to form smoke. Therefore, in any of the embodiments described above, the aerosol-generating substrate may comprise a tobacco rod.

Alternatively, aerosol-generating articles according to the present invention may be articles in which a tobacco material is heated to form an aerosol, rather than combusted. In one type of heated aerosol-generating article, a tobacco material is heated by one or more electrical heating elements to produce an aerosol. In another type of heated aerosol-generating article, an aerosol is produced by the transfer of heat from a combustible or chemical heat source to a physically separate tobacco material, which may be located within, around or downstream of the heat source. The present invention further encompasses aerosol-generating articles in which a nicotine-containing aerosol is generated from a tobacco material, tobacco extract, or other nicotine source, without combustion, and in some cases without heating, for example through a chemical reaction.

In any of the embodiments described above, the at least one filter segment may be a single segment. Alternatively, the mouthpiece may comprise multiple filter segments. Where two or more filter segments are provided, the filter segments may be of the same construction and materials as each other or they may have a different construction, or contain different filtration material or additives. For example, at least one filter segment may include at least one of a flavourant material, such as a particulate flavourant material, dispersed within a segment of filtration material, a flavourant-containing capsule, flavoured botanicals, a flavoured thread or flavoured yarn, and the like. Additionally, or alternatively, at least one filter segment may comprise at least one sorbent capable of removing at least one gas phase constituent from mainstream smoke or other aerosol drawn through the filter. Preferably, the at least one sorbent is selected from the group comprising activated carbon, beaded activated carbon, active aluminium, zeolites, sepiolites, molecular sieves and silica gel.

Preferably, the filtration material within each filter segment is a plug of fibrous filtration material, such as cellulose acetate tow or paper. A filter plasticiser may be applied to the fibrous filtration material in a conventional manner, by spraying it onto the separated fibres, preferably before any particulate material is applied to the filtration material.

Figure 2:
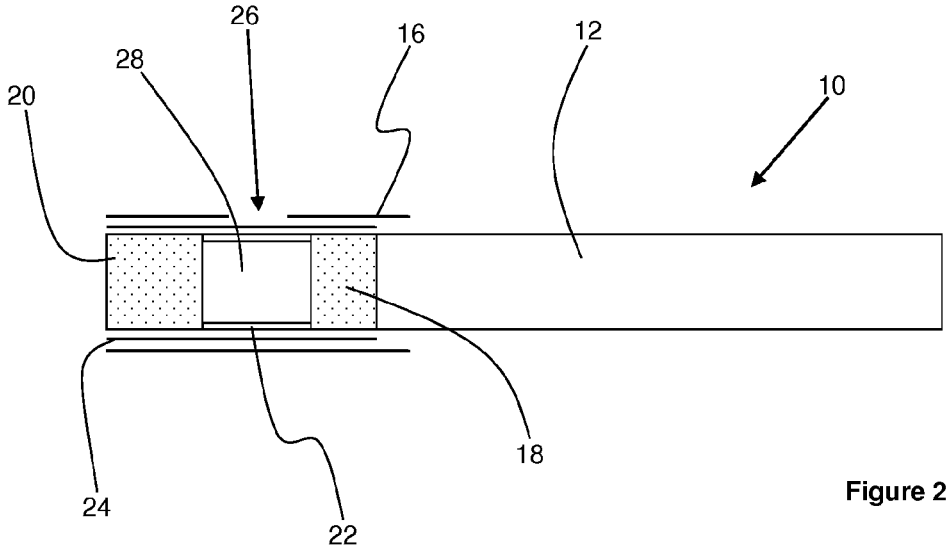
FIG. 2 shows a longitudinal cross-sectional view of the aerosol-generating article of FIG. 1.
Figure 3:
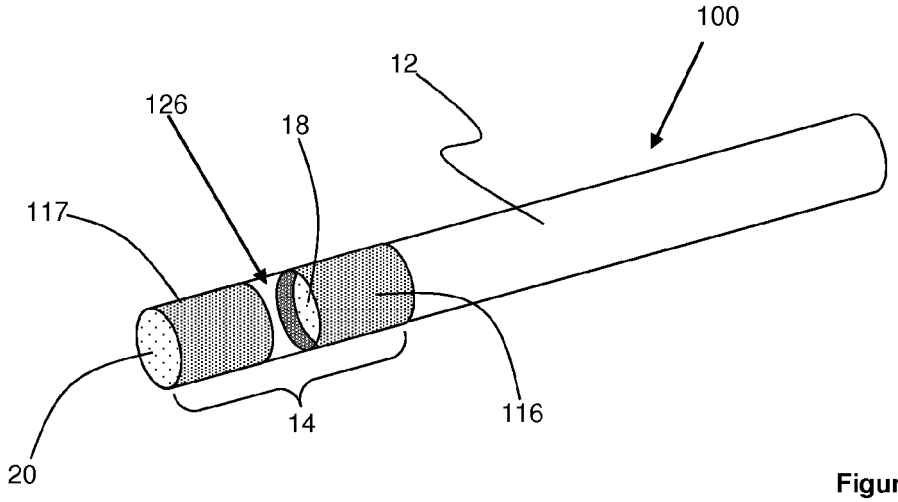
FIG. 3 shows a perspective view of an aerosol-generating article in accordance with a second embodiment of the present invention.
Figure 4:
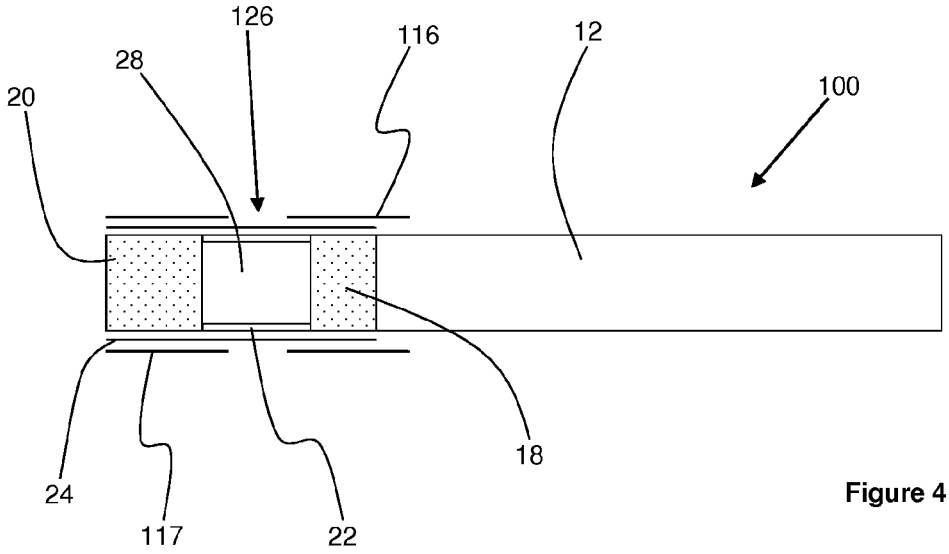
FIG. 4 shows a longitudinal cross-sectional view of the aerosol-generating article of FIG. 3.

The invention will now be further described, by way of example only, with reference to the accompanying drawings in which:

FIG. 1 shows a perspective view of an aerosol-generating article in accordance with a first embodiment of the present invention;

FIG. 2 shows a longitudinal cross-sectional view of the aerosol-generating article of FIG. 1;

FIG. 3 shows a perspective view of an aerosol-generating article in accordance with a second embodiment of the present invention; and FIG. 4 shows a longitudinal cross-sectional view of the aerosol-generating article of FIG. 3.

FIG. 1 shows an aerosol-generating article 10 according to a first embodiment of the present invention. The aerosol-generating article 10 is a filter cigarette comprising an aerosol-generating substrate 12 in the form of a wrapped tobacco rod, and a mouthpiece 14. The mouthpiece 14 is secured to the wrapped tobacco rod by a tipping wrapper 16.

As shown more clearly in FIG. 2, which shows a longitudinal cross-sectional view of the aerosol-generating article 10 of FIG. 1, the mouthpiece 14 comprises a first filter segment 18 at an upstream end of the mouthpiece 14 and a second filter segment 20 at a downstream end of the mouthpiece 14. The mouthpiece 14 further comprises a substantially transparent tubular segment 22 positioned between the first and second filter segments 18, 20. A substantially transparent combining plug wrap 24 is wrapped around the first and second filter segments 18, 20 and the substantially transparent tubular segment 22 to combine them and form the mouthpiece 14.

A cut-out portion 26 in the tipping wrapper 16 overlies the substantially transparent tubular segment 22 and the substantially transparent combining plug wrap 24 so that, during smoking of the aerosol-generating article 10, the consumer can observe the mainstream smoke from the wrapped tobacco rod passing through an empty channel 28 defined by the substantially transparent tubular segment 22.

FIGS. 3 and 4 show an aerosol-generating article 100 according to a second embodiment of the present invention. The aerosol-generating article 100 shown in FIGS. 3 and 4 is a filter cigarette having a similar construction to the aerosol-generating article 10 shown in FIGS. 1 and 2. Therefore, like reference numerals are used to designate like parts.

The difference between the aerosol-generating articles 10, 100 of FIGS. 1 and 3 is in the tipping wrapper. Specifically, whereas the aerosol-generating article 10 shown in FIG. 1 comprises a single tipping wrapper 16 having a cut-out portion 26 therein, the aerosol-generating article 100 shown in FIGS. 3 and 4 comprises a first tipping wrapper 116 and a second tipping wrapper 117.

The first tipping wrapper 116 is provided at an upstream end of the mouthpiece 14 and is wrapped around a downstream end of the wrapped tobacco rod, the first filter segment 18 and an upstream end of the substantially transparent tubular segment 22. The first tipping wrapper 116 therefore secures the mouthpiece 14 to the aerosol-generating substrate 12.

The second tipping wrapper 117 is spaced apart from the first tipping wrapper 116 and is wrapped around the second filter segment 20 and a downstream end of the substantially transparent tubular segment 22.

Spacing apart the first and second tipping wrappers 116, 117 forms an aperture band 126 between the two tipping wrappers, wherein the aperture band 126 extends around the full circumference of the mouthpiece 14 and overlies the substantially transparent tubular segment 22 and the substantially transparent combining plug wrap 24. Therefore, during smoking, the aperture band 126 allows the consumer to observe the mainstream smoke from the wrapped tobacco rod passing through the empty channel 28 defined by the substantially transparent tubular segment 22.

The embodiments and examples shown in FIGS. 1 to 4 and described above illustrate but do not limit the invention. Other embodiments of the invention may be made without departing from the scope thereof, and it is to be understood that the specific embodiments described herein are not limiting. In particular, it will be appreciated that whilst the specific embodiments described above relate to conventional smoking articles comprising a combustible tobacco rod, a similar arrangement could also be used on a distillation-based smoking article or an electrically heated smoking article.

The invention claimed is:

1. An aerosol-generating article comprising:

an aerosol-generating substrate;

a mouthpiece secured to the aerosol-generating substrate, the mouthpiece comprising at least one filter segment and a substantially transparent tubular segment axially aligned in an abutting end-to-end relationship with the at least one filter segment and defining an empty cavity extending substantially longitudinally through the substantially transparent tubular segment, wherein aerosol passing through the empty cavity during use of the aerosol-generating article is visible from the exterior of the aerosol-generating article through the substantially transparent tubular segment.

2. The aerosol-generating article according to claim 1, wherein an outer diameter of the at least one filter segment is substantially the same as an outer diameter of the substantially transparent tubular segment.

3. The aerosol-generating article according to claim 1, further comprising a substantially transparent wrapper circumscribing at least a portion of each of the substantially transparent tubular segment and the at least one filter segment to secure the substantially transparent tubular segment to the at least one filter segment.

4. The aerosol-generating article according to claim 1, further comprising a tipping wrapper circumscribing an end portion of the aerosol-generating substrate and at least a portion of the mouthpiece to secure the mouthpiece to the aerosol-generating substrate, wherein the tipping wrapper comprises at least one cut-out portion overlying at least a portion of the substantially transparent tubular segment so that the substantially transparent tubular segment is visible through the at least one cut-out portion.

5. The aerosol-generating article according to claim 1, further comprising a first tipping wrapper circumscribing an end portion of the aerosol-generating substrate and a portion of the mouthpiece to secure the mouthpiece to the aerosol-generating substrate, wherein at least a portion of the substantially transparent tubular segment does not underlie the first tipping wrapper so that at least a portion of the substantially transparent tubular segment is visible.

6. The aerosol-generating article according to claim 5, further comprising a second tipping wrapper circumscribing a portion of the mouthpiece, wherein an upstream end of the second tipping wrapper is spaced apart from a downstream end of the first tipping wrapper to define an aperture band between the first and second tipping wrappers, wherein at least a portion of the substantially transparent tubular segment underlies the aperture band.

7. The aerosol-generating article according to claim 1, wherein the substantially transparent tubular segment comprises at least one thermoplastic.

8. The aerosol-generating article according to claim 1, wherein the substantially transparent tubular segment comprises at least one of polyethylene, low density polyethylene (LDPE), high density polyethylene (HDPE), acrylonitrile butadiene styrene (ABS), polypropylene, polystyrene, polycarbonate, polyvinyl chloride (PVC), or a mixture thereof.

9. The aerosol-generating article according to claim 1, further comprising a coating material on an inner surface of the substantially transparent tubular segment, wherein the coating material comprises at least one of a hydrophobic substance, an oleophobic substance, a hydrophobic and oleophobic substance, or a mixture thereof.

10. The aerosol-generating article according to claim 1, wherein the at least one filter segment comprises a first filter segment and a second filter segment, and wherein the substantially transparent tubular segment is positioned between the first and second filter segments.

11. The aerosol-generating article according to claim 1, wherein the substantially transparent tubular segment is positioned at a mouth end of the mouthpiece so that the substantially transparent tubular segment forms a mouth end recess.

12. The aerosol-generating article according to claim 1, wherein the substantially transparent tubular segment has a length of between 2 millimeters and 20 millimeters.

13. The aerosol-generating article according to claim 1, wherein the substantially transparent tubular segment has a wall thickness of between 0.1 millimeters and 2 millimeters.

14. The aerosol-generating article according to claim 1, wherein the substantially transparent tubular segment has an inner diameter of between 2 millimeters and 7 millimeters.

15. The aerosol-generating article according to claim 1, wherein the aerosol-generating substrate comprises a tobacco rod.

* * * * *